US005697855A

United States Patent [19]

Aizawa

[11] Patent Number: 5,697,855

[45] Date of Patent: Dec. 16, 1997

[54] GOLF CLUB HEAD

[75] Inventor: Yuichi Aizawa, Tokyo, Japan

[73] Assignee: Daiwa Seiko, Inc., Tokyo, Japan

[21] Appl. No.: 573,223

[22] Filed: Dec. 15, 1995

[30] Foreign Application Priority Data

Dec. 16, 1994 [JP] Japan ..... HEI. 6-313070

[51] Int. Cl.[6] ..... A63B 53/04

[52] U.S. Cl. ..... 473/350; 473/332; 473/342; 473/349

[58] Field of Search ..... 473/342, 345, 473/350, 324, 332, 335, 329, 349

[56] References Cited

U.S. PATENT DOCUMENTS

| | | | |
|---|---|---|---|
| 2,846,228 | 8/1958 | Reach | 473/350 |
| 5,176,384 | 1/1993 | Sata | 473/329 |
| 5,316,298 | 5/1994 | Hutin | 473/332 |
| 5,346,219 | 9/1994 | Pehoski | 473/329 |
| 5,540,436 | 7/1996 | Boone | 473/350 |

FOREIGN PATENT DOCUMENTS

| | | |
|---|---|---|
| 3-3342 | 1/1991 | Japan . |
| 5-61951 | 9/1993 | Japan . |

*Primary Examiner*—Sebastiano Passaniti
*Assistant Examiner*—Stephen L. Blau
*Attorney, Agent, or Firm*—Longacre & White

[57] ABSTRACT

The invention concerns a golf club head in which by fully utilizing restitution characteristics of a face plate made of a high-elasticity material, the directional stability of a ball and a flying distance are enhanced, and also a good ball-hitting feel is obtained. In the golf club head of the invention, a through hole is formed through a face portion of a metal head body with a peripheral portion thereof remaining. A face plate, which is smaller in specific gravity than the head body, is mounted on the face portion in such a manner that the face plate is supported by a fitting recess portion formed at a peripheral edge portion of the through hole. A vibration-absorbing member, which is lower in elasticity than the face plate, is mounted on a back surface of the face plate in spaced relation to the head body.

11 Claims, 5 Drawing Sheets

GOLF CLUB HEAD

BACKGROUND OF THE INVENTION

This invention relates to a golf club head which is designed to achieve the directional stability of a ball and an improved flying distance, and also to enhance a ball-hitting feel.

Generally, in a head body of an iron club, a hosel portion, a sole portion, a face portion and so on are integrally formed of metal such as stainless steel and soft iron, and each individual club in the set has a configuration suited for its purpose. However, the head body is formed of a lump of metal, and hence has low elasticity, and particularly when the face portion, which is most important for applying an impact to the ball, has no elasticity, a coefficient of restitution is low, and a soft hitting feel as achieved by a wood club can not be obtained.

Therefore, as shown in FIGS. 7 and 8, there has recently been proposed an iron club 13 (see Japanese Patent Examined Publication No. 5-61951) in which a through hole 7 is formed through a head body 1 of a metal material (e.g. stainless steel) to extend from a face portion 3 to a back portion 5, with its peripheral portion remaining, and a thin face plate 11 is fitted in a fitting recess 9 formed in the face portion 3.

This face plate 11 is molded of a fiber-reinforced resin, which uses, for example, carbon fibers as reinforcing fibers, and has a configuration corresponding to that of the fitting recess 9. This face plate 11 is fitted in the fitting recess 9 through a vibration-absorbing material 15, such as rubber, in such a manner that the face plate 11 is disposed flush with the face portion 3. A plurality of score line grooves 17 are formed in the surface of this face plate, and these score line grooves 17 impart a spinning motion to the ball when hitting the ball.

In the above iron club 13, the face plate 11 is lower in specific gravity than the head body 1, and therefore the weight of the head body 1 is distributed over the peripheral portion. As a result, a moment of inertia of the head body 1 increases during the swing, thereby achieving directional stability, and also since there is not provided any member at the back side of the face plate 11 for backing up an elastically-deforming action of the face plate 11, restitution characteristics inherent to the face plate 11 can be imparted to the ball when hitting the ball, so that the flying distance of the ball can increase.

In the drawings, reference numeral 19 denotes a shaft fitted in a hosel portion 21 of the head body 1.

On the other hand, natural wood, such as persimmon and cherry, has been extensively used as a material for a head body of wood clubs. Recently, however, in view of the stability of the quality, the ease of supply of materials and so on, wood clubs of the type, in which a hollow shell of a head body is cast of metal such as titanium and an aluminum alloy, have been extensively used instead of such natural wood clubs.

In order to ensure a flying distance, as disclosed in Japanese Utility Model Examined Publication No. 3-3342, a fitting recess is formed in a face portion of the head body, and a face plate of a fiber-reinforced resin is fitted in this fitting recess as described above. With this construction, a coefficient of restitution is enhanced upon application of an impact to a ball, thereby ensuring a flying distance and also absorbing the impact produced when hitting the ball, thus alleviating the burden to the elbows.

In the iron club 13 of FIG. 7, since vibrations are liable to develop in the separate face plate 11 mounted on the head body 1, the face plate 11 is fitting in the fitting recess 9 through the vibration-absorbing member 15. However, it has been pointed out that the vibration-absorbing member 15 affects the restitution characteristics of the face plate 11.

More specifically, if the face plate 11 is fitted directly in the fitting recess 9, vibrations, developing in the face plate 11 when hitting the ball, are transmitted to the player through the head body 1 and the shaft 19. Therefore, the above vibration-absorbing member 15 is interposed so as to absorb the vibrations.

However, when the vibration-absorbing member 15 is thus interposed between the head body 1 and the face plate 11, the vibration-absorbing member 15, held between the head body 1 and the face plate 11, is also compressed and restored, and therefore there has been encountered a disadvantage that the properties, possessed by the vibration-absorbing member 15, affect the restitution characteristics of the face plate 11, thus failing to fully utilize the characteristics of the high-elasticity material.

In the above-mentioned wood club, also, when the face plate is mounted in the fitting recess formed in the face portion, the elastically-deforming action of the face plate is fully backed up by the head body, thus inviting a problem that the restitution properties, possessed by the face plate, can not be fully exhibited, so that a satisfactory flying distance is not achieved.

SUMMARY OF THE INVENTION

The present invention has been made in view of the above problems, and an object of the invention is to provide a golf club head in which by fully utilizing restitution characteristics of a face plate made of a high-elasticity material, the directional stability of a ball and a flying distance are enhanced, and also a good ball-hitting feel is obtained.

The above object has been achieved by a golf club head of the invention characterized in that a through hole is formed through a face portion of a metal head body with a peripheral portion thereof remaining; a face plate, which is smaller in specific gravity than the head body, is mounted on the face portion in such a manner that the face plate is supported by a peripheral edge portion of the through hole; and a vibration-absorbing member, which is lower in elasticity than the face plate, is mounted on a back surface of the face plate in spaced relation to the head body.

Preferably, the vibration-absorbing member is mounted at a sweet spot-corresponding position.

As described above, when swinging the golf club having the golf club head of the claims, the weight of the head body is distributed over the peripheral portion thereof, so that a large moment of inertia is obtained, and as a result the head body moves along an accurate swing path without any deviation.

And besides, although the vibration-absorbing member is mounted on the back surface of the face plate, the vibration-absorbing member will not entirely back up an elastically-deforming action of the face plate in cooperation with the head body, and therefore restitution characteristics of the face plate of a high-elasticity material are fully exhibited.

Furthermore, vibrations, produced in the face plate when hitting the ball, are absorbed by the vibration-absorbing member. At this time, since the vibration-absorbing member is not in contact with the head body, the vibration-absorbing member will not affect the restitution characteristics of the face plate.

DETAILED DESCRIPTION OF THE PREFERRED EMBODIMENTS

A preferred embodiment of the present invention will now be described in detail with reference to the drawings.

Figure 1:
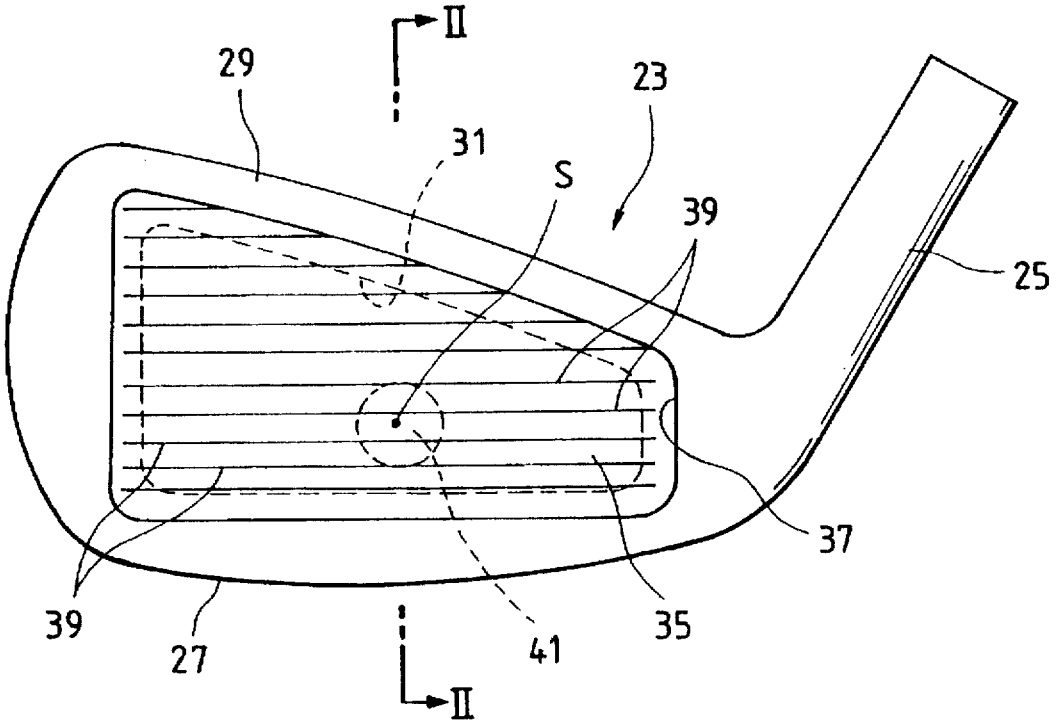
FIG. 1 is a front-elevational view of one preferred embodiment of a golf club head of the present invention.
Figure 2:
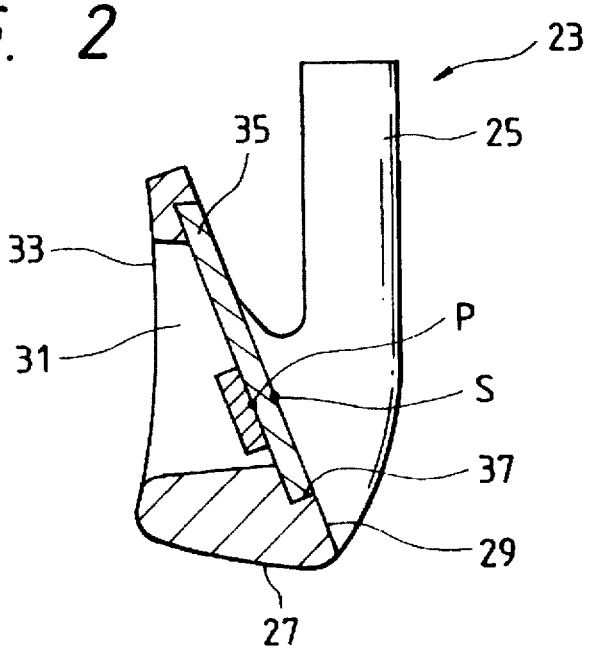
FIG. 2 is a cross-sectional view taken along the line II—II of FIG. 1.

FIG. 1 shows a first embodiment of a golf club head of the present invention. In the drawings, a head body 23 of an iron club is formed of a metal material such as soft iron (Specific gravity: 7.8), stainless steel (Specific gravity: 7.7), titanium (Specific gravity: 4.5) and beryllium copper (Specific gravity: 8.3). In the head body 23, a hosel portion 25, a sole portion 27, a face portion 29 and so on are formed in an integral manner as in the conventional construction, and a through hole 31 is formed through the face portion 29 of the head body 23, and extends to a back portion 33, with its peripheral portion remaining, as shown in FIG. 2.

In the drawings, a thin face plate 35 is molded of a fiber-reinforced resin (Specific gravity: 1.4 to 1.6) using carbon fibers or the like as reinforcing fibers. The face plate 35 is formed into a shape corresponding to that of a fitting recess 37 formed in the peripheral portion of the face portion 29, and this face plate 35 is fixedly mounted in the fitting recess 27 in such a manner that the face plate 35 is flush with the face portion 29. A plurality of score line grooves 39 are formed in the surface of the face plate 35, and these score line grooves 39 impart a spinning motion to a ball when hitting the ball as in the conventional construction.

The head body 23 of this embodiment has the construction as described above for the conventional construction, and besides has a feature that a vibration-absorbing member 41, made of a material lower in elasticity (i.e. elastic modulus) than the face plate 35, is mounted on the back side or surface of the face plate 35 in non-contact or spaced relation to the head body 23.

The vibration-absorbing member 41 is made of rubber, a synthetic resin (epoxy, polyurethane, polycarbonate, polyvinyl chloride), which have rubber elasticity or visco-elasticity, or a rigid synthetic resin lower in elasticity than the face plate 35. The vibration-absorbing member 41 is in the form of a circular plate or disk having a thickness of not less than 0.1 mm, and is fixedly secured to the back surface of the face plate 35 at a sweet spot-corresponding position P (where a line, extending perpendicularly from a sweet spot S on a hitting surface, intersects the back surface of the face plate 35) by an adhesive, welding, press-bonding or the like.

The vibration-absorbing member 41 is so sized that it, when mounted on the back surface of the face plate 35, will not contact the peripheral portion at the back portion of the head body 23. Vibrations, developing in the face plate 35 when hitting the ball, are absorbed and attenuated by this vibration-absorbing member 41.

As described above, in the head body 23 of this embodiment, the through hole 31 is formed through the face portion 29, and extends to the back portion 33, with the peripheral portion remaining, and the face plate 35 smaller in specific gravity than the head body 23 is fitted in the fitting recess 37, formed in the face portion 29, to close the through hole 31, and the vibration-absorbing member 41, made of a material lower in elasticity than the face plate 35, is mounted on the back surface of the face plate 35 at the sweet spot-corresponding position P in non-contact or spaced relation to the head body 23. Therefore, when swinging a golf club having this head body 23 secured thereto, the weight of the head body 23 is distributed over the peripheral portion of the head body, so that a large moment of inertia is obtained, and as a result the head body 23 moves along an accurate swing path without any deviation, thereby achieving the direction-al stability of the ball.

Although the vibration-absorbing member 41 is mounted on the back surface of the face plate 35, the vibration-absorbing member 41 will not entirely back up an elastically-deforming action of the face plate 35 in cooperation with the head body 23. Therefore, restitution characteristics of the face plate 35 are fully exhibited, thereby increasing the flying distance.

Figure 7:
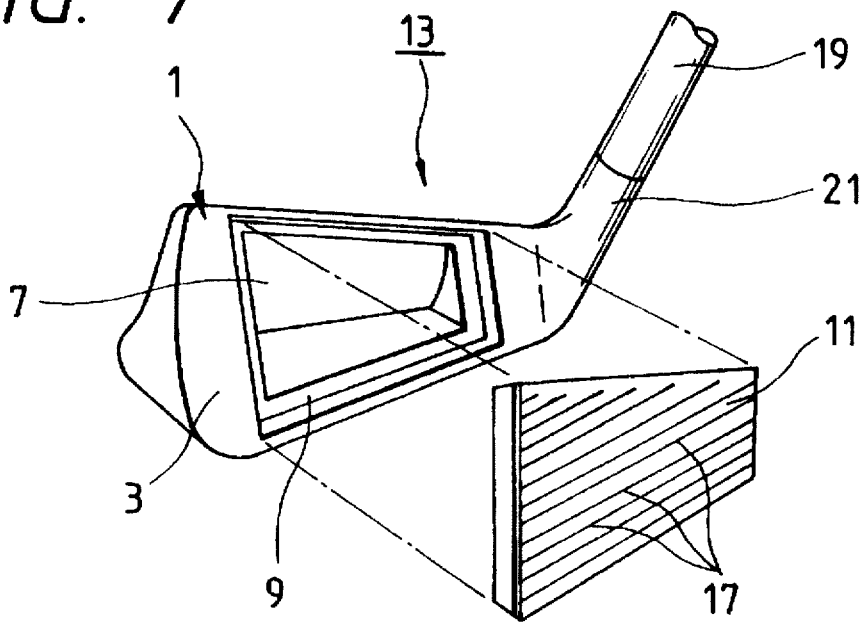
FIG. 7 is an exploded, perspective view of a conventional golf club head.
Figure 8:
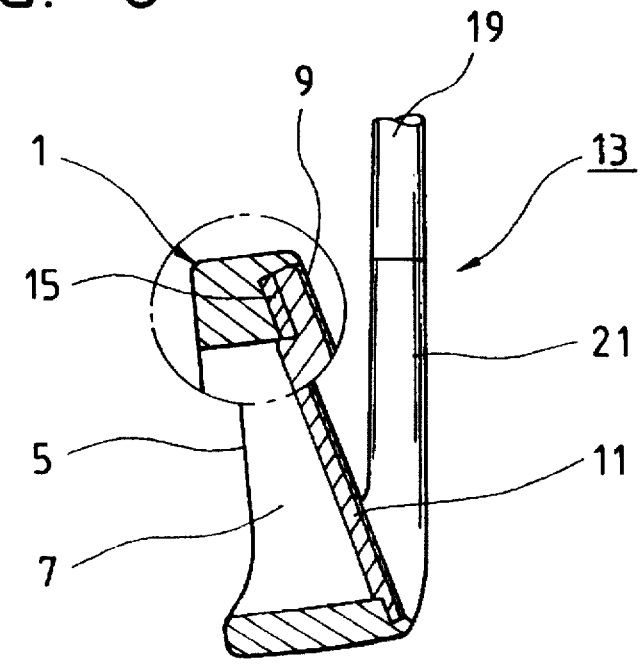
FIG. 8 is a cross-sectional view of the golf club head of FIG. 7.

And besides, vibrations, produced in the face plate 35 when hitting the ball, are absorbed by the vibration-absorbing member 41, thereby attenuating the vibrations to be transmitted to the player. In the conventional construction shown in FIGS. 7 and 8, since the vibration-absorbing member 15 is interposed between the head body 1 and the face plate 11, the vibration-absorbing member 15 itself is also compressed and restored by an impact produced when hitting the ball, so that the properties, possessed by the vibration-absorbing member 15, have affected the restitution characteristics of the face plate 11.

In this embodiment, however, since the vibration-absorbing member 41 is spaced from the head body 23, the vibration-absorbing member 41 will not be compressed and restored by an impact produced when hitting the ball, and hence will not affect the restitution characteristics of the face plate 35.

Therefore, disagreeable vibrations, produced when hitting the ball, can be attenuated without affecting the restitution characteristics of the face plate 35, and in this embodiment a good hitting feel can be obtained while securing a satisfactory flying distance.

The face plate 35 of this embodiment can be formed of other materials than a fiber-reinforced resin (FRP), such as metal (e.g. stainless steel, a titanium alloy, beryllium alloy or an aluminum alloy) and FRM using such metal. A synthetic resin (including FRP), rubber, magnesium, lead, an aluminum alloy and so on can be suitably used for forming the vibration-absorbing member 41.

Figure 3:
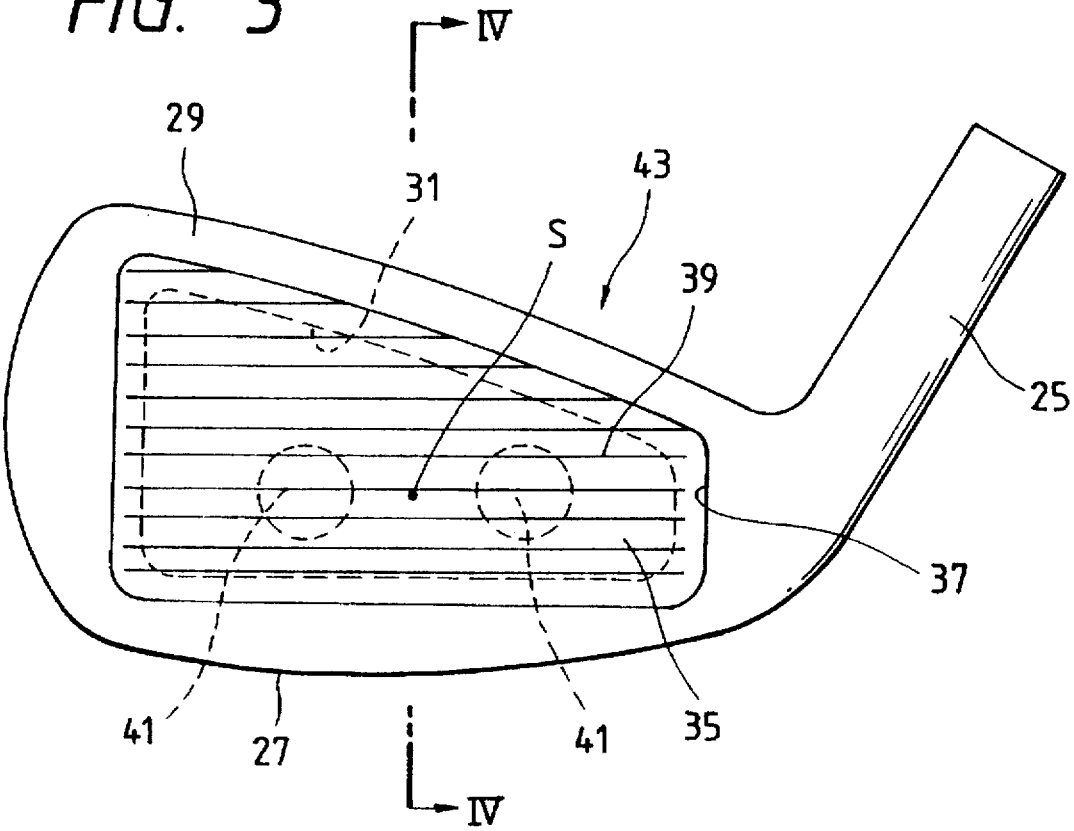
FIG. 3 is a front-elevational view of another embodiment of a golf club head of the present invention.
Figure 4:
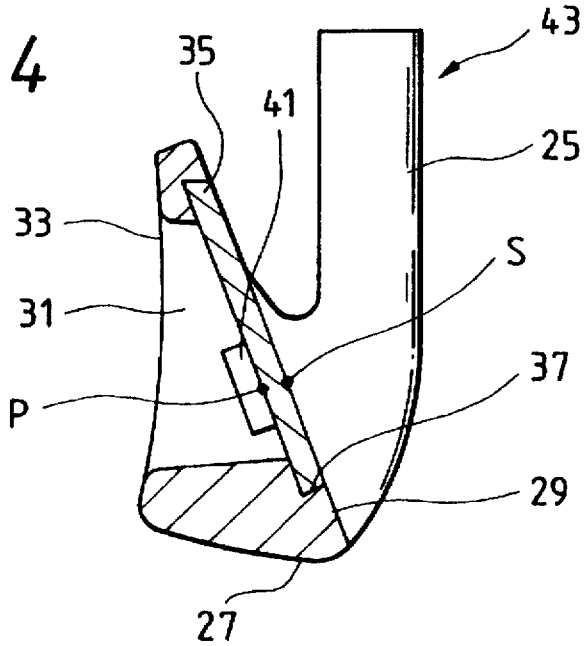
FIG. 4 is a cross-sectional view taken along the line IV—IV of FIG. 3.
Figure 9:
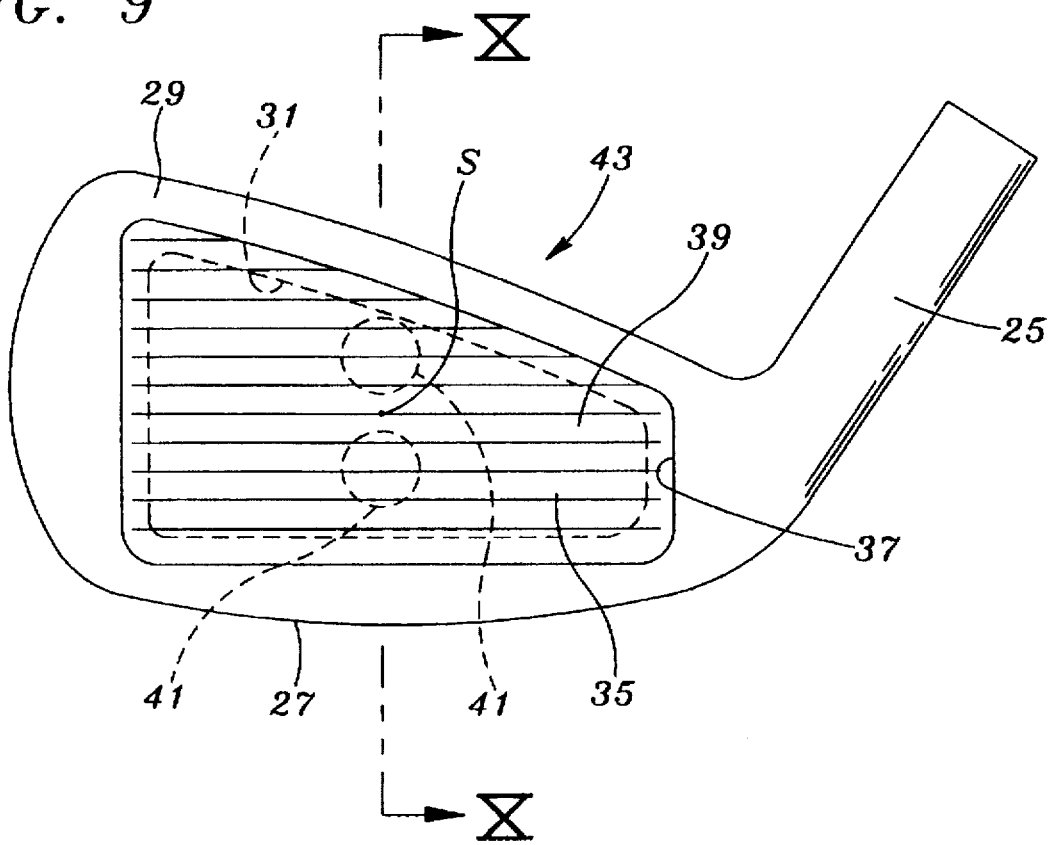
FIG. 9 is a front-elevational view of another embodiment of a golf club head of the present invention.
Figure 10:
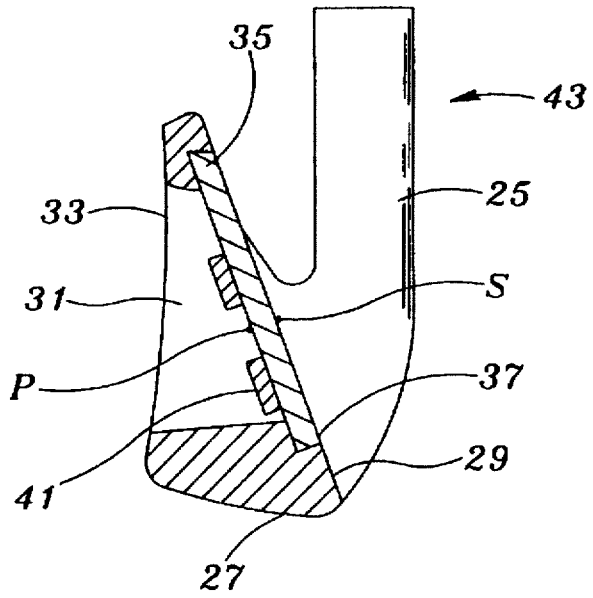
FIG. 10 is a cross sectional view taken along line X—X of FIG. 9.

FIGS. 3 and 4 show another embodiment of the present invention. In the preceding embodiment, the vibration-absorbing member 41 is mounted on the back surface of the face plate 35 at the sweet spot-corresponding position P. However, in a head body 43 of this embodiment, vibration-absorbing members 41 as described above are mounted respectively on a toe-side portion and a heel-side portion of a back surface of a face plate 35 in spaced relation to the head body 43 in such a manner that a sweet spot-corresponding position P is disposed between the two vibration-absorbing members 41. The vibration-absorbing members 41 may be mounted respectively on a top-side portion and a sole-side portion of a back surface of a face plate 35 in spaced relation to the head body 43 in such a manner that a sweet spot-corresponding position P is disposed between the two vibration-absorbing members 41 as shown in FIGS. 9 and 10.

When hitting the ball off sweet spot S, the vibrations are larger than when hitting the ball at the sweet spot S, since the ball fails to be accurately hit.

Therefore, in this embodiment, the vibration-absorbing members 41 are mounted respectively on the toe-side portion and heel-side portion of the back surface of the face plate 35 in non-contact or spaced relation to the head body 43 in such a manner that the sweet spot-corresponding position P is disposed between the two vibration-absorbing members 41. The other construction is the same as described for the preceding embodiment, and identical portions are designated respectively by identical reference numerals, and explanation thereof is omitted here.

In this embodiment, large vibrations, produced when hitting the ball off sweet spot S, are absorbed by the two vibration-absorbing members 41.

Therefore, this embodiment is most suited for a golf club for beginners who can not hit the ball accurately at the sweet spot S. The intended object can be achieved by this embodiment as in the preceding embodiment.

Figure 5:
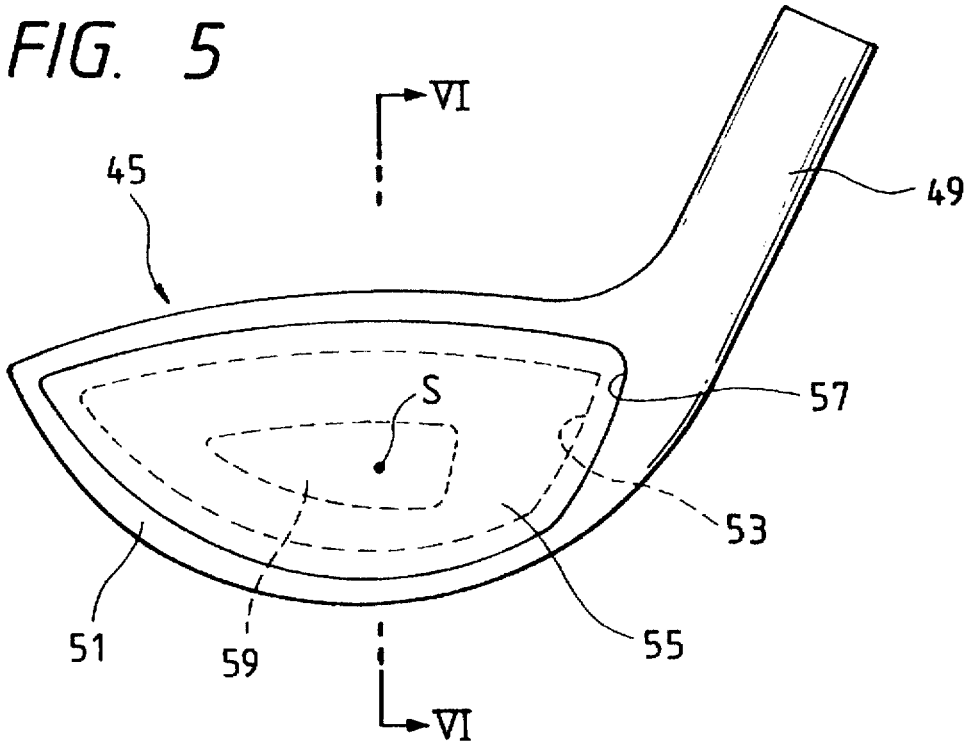
FIG. 5 is a front-elevational view of another embodiment of a golf club head of the present invention.
Figure 6:
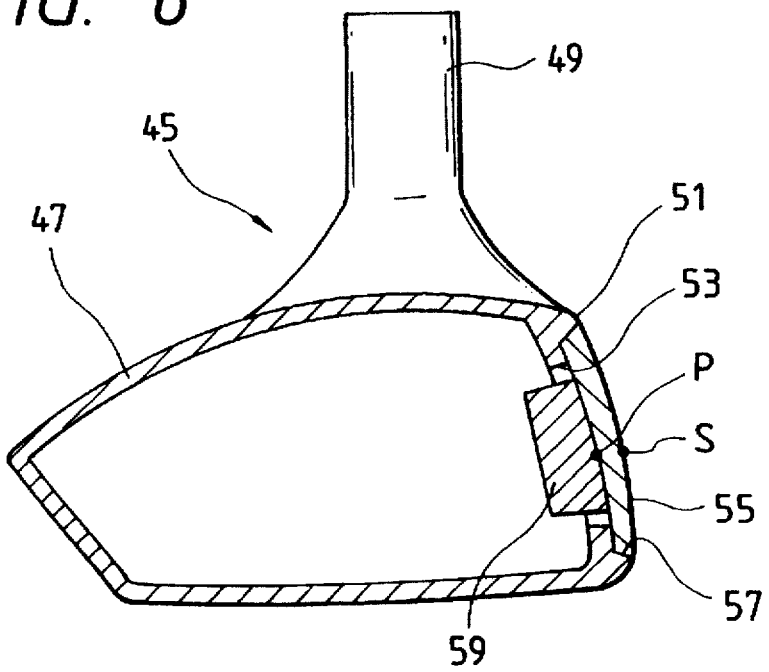
FIG. 6 is a cross-sectional view taken along the line VI—VI of FIG. 5.

FIG. 5 shows yet another embodiment of a golf club head of the present invention. In this Figure, a head body 45 includes a hollow shell 47 cast of a metal material such as titanium and stainless steel, and a hosel portion 49 extends obliquely upwardly from a heel portion of the head body 45, and a shaft, formed of metal or a resin such as FRP, is adapted to be fitted in this hosel portion 49. A through hole 53 is formed through a face portion 51, and extends into the interior of the head body 45, with a peripheral portion thereof remaining.

In the drawings, a thin face plate 55 is formed of a beryllium alloy (Specific gravity: 1.7), an aluminum alloy (Specific gravity: 2.8), which are smaller in specific gravity than the head body 45, a fiber-reinforced resin, or the like. The face plate 55 is formed into a shape corresponding to that of a fitting recess 57 formed in a peripheral portion of the face portion 51 adjacent to a peripheral edge of the through hole 53, and this face plate 55 is fixedly mounted in the fitting recess 57 in such a manner that the face plate 55 is flush with the face portion 51.

A vibration-absorbing member 59 is made of a material, such as rubber, a synthetic resin (as described above for the vibration-absorbing member 41) or lead, which is lower in elasticity than the face plate 55, and this vibration-absorbing member 59 has a thickness of not less than 0.1 mm. The vibration-absorbing member 59 is mounted on a back surface of the face plate 55 at a sweet spot-corresponding position P in spaced relation to the head body 45 by an adhesive, welding or the like.

The vibration-absorbing member 59 is generally similar in shape to the face plate 55, and is so sized that it does not contact the peripheral portion of the head body 45. Vibrations, produced in the face plate 55 when hitting the ball, are absorbed and attenuated by the vibration-absorbing member 59.

With this construction of the head body 45 of this embodiment, when swinging a golf club having the head body 45 secured thereto, the weight of the head body 45 is distributed over the peripheral portion of the head body, so that a large moment of inertia is obtained, and as a result the head body 45 moves along an accurate swing path without any deviation, thereby achieving the directional stability of the ball.

Although the vibration-absorbing member 59 is mounted on the back surface of the face plate 55, the vibration-absorbing member 59, spaced from the head body 45, will not entirely back up an elastically-deforming action of the face plate 55 in cooperation with the head body 45. Therefore, restitution characteristics of the face plate 55 of a high-elasticity material are fully exhibited, thereby increasing the flying distance.

And besides, vibrations, produced in the face plate 55 when hitting the ball, are absorbed by the vibration-absorbing member 59, thereby attenuating the vibrations to be transmitted to the player. In this embodiment, since the vibration-absorbing member 59 is not in contact with the head body 45, the vibration-absorbing member 59 will not be compressed and restored by an impact produced when hitting the ball, and hence will not affect the restitution characteristics of the face plate 55.

Therefore, in this embodiment, disagreeable vibrations, produced when hitting the ball, can be attenuated without affecting the restitution characteristics of the face plate 55, and a good hitting feel can be obtained while securing a satisfactory flying distance.

The vibration-absorbing member does not always need to be formed of a single material, but can be formed into a laminate construction using a plurality of materials.

As described above, when swinging the golf club with the golf club head as defined in either of the claims, the weight of the head body is distributed over the peripheral portion thereof, so that a large moment of inertia is obtained, and as a result the head body moves along an accurate swing path without any deviation, thereby achieving the directional stability of the ball.

And besides, although the vibration-absorbing member is mounted on the back surface of the face plate, the vibration-absorbing member will not entirely back up the elastically-deforming action of the face plate in cooperation with the head body, and therefore the restitution characteristics of the face plate of a high-elasticity material are fully exhibited, thereby increasing the flying distance.

Furthermore, vibrations, produced in the face plate when hitting the ball, are absorbed by the vibration-absorbing member, thereby attenuating the vibrations to be transmitted to the player. At this time, since the vibration-absorbing member is spaced from the head body, the vibration-absorbing member will not be compressed and restored by an impact produced when hitting the ball, and hence will not affect the restitution characteristics of the face plate.

Therefore, in the golf club head as defined in either of the claims, disagreeable vibrations, produced when hitting the ball, can be attenuated by the vibration-absorbing member without affecting the restitution characteristics of the face plate, and therefore a good hitting feel can be obtained while securing a satisfactory flying distance.

What is claimed is:

1. A golf club head comprising: a through hole formed through a face portion of a metal head body with a peripheral portion thereof remaining; a face plate, which is smaller in specific gravity than said head body, is mounted on said face portion in such a manner that said face plate is supported by a peripheral edge portion of said through hole; and at least one vibration-absorbing member, which is lower in elastic modulus than said face plate, is mounted directly on a back surface of said face plate in spaced relation to said head body; wherein said vibration damper has a peripheral surface confined to an area of said back surface substantially adjacent a sweet spot corresponding position.

2. A golf club head according to claim 1, wherein said face plate is made of material higher in elastic modulus than said head body.

3. A golf club head according to claim 1, wherein a fitting recess portion is formed in said peripheral edge portion of said thorough hole so as to support said face plate.

4. A golf club head according to claim 1, wherein said face plate is mounted so as to close said through-hole.

5. A golf club head according to claim 1, wherein said vibration-absorbing member is made of elastic rubber.

6. A golf club head according to claim 1, wherein said vibration-absorbing member is made of visco-elastic material.

7. A golf club head according to claim 1, wherein said vibration-absorbing member is made of rigid synthetic resin.

8. A golf club head according to claim 1, wherein said vibration-absorbing member is made of metal lower in elastic modulus than said face plate.

9. A golf club head comprising: a through hole formed through a face portion of a metal head body with a peripheral portion thereof remaining; a face plate, which is smaller in specific gravity than said head body, is mounted on said face portion in such a manner that said face plate is supported by a peripheral edge portion of said through hole; and at least two vibration-absorbing members, which is lower in elastic modulus than said face plate, each mounted on a back surface of said face plate in spaced relation to said head body, each of said at least two vibration-absorbing members are located at a position other than a sweet spot corresponding position.

10. A golf club according to claim 9, wherein said at least two vibration-absorbing members are respectively located at a toe-side portion and a heel side portion of said face plate so that said sweet spot corresponding position is located between said vibration-absorbing members.

11. A golf club according to claim 9, wherein said at least two vibration-absorbing members are respectively located at a top-side portion and a sole side portion of said face plate so that said sweet spot corresponding position is located between said vibration-absorbing members.

* * * * *